US011253869B2

(12) United States Patent
Montes Atenas et al.

(10) Patent No.: US 11,253,869 B2
(45) Date of Patent: Feb. 22, 2022

(54) MAGNETO-CENTRIFUGAL FLOTATION CELL FOR CONCENTRATING MATERIALS WHICH REDUCES WATER CONSUMPTION AND METHOD OF USE

(71) Applicant: UNIVERSIDAD DE CHILE, Santiago (CL)

(72) Inventors: Gonzalo Montes Atenas, Santiago (CL); Aldo César Sebastián Casali Bacelli, Santiago (CL)

(73) Assignee: UNIVERSIDAD DE CHILE, Santiago (CL)

( * ) Notice: Subject to any disclaimer, the term of this patent is extended or adjusted under 35 U.S.C. 154(b) by 294 days.

(21) Appl. No.: 16/473,361

(22) PCT Filed: Dec. 22, 2017

(86) PCT No.: PCT/CL2017/000042

§ 371 (c)(1),
(2) Date: Jun. 25, 2019

(87) PCT Pub. No.: WO2018/119527

PCT Pub. Date: Jul. 5, 2018

(65) Prior Publication Data

US 2020/0139380 A1 May 7, 2020

(30) Foreign Application Priority Data

Dec. 26, 2016 (CL) ..... 3331-2016

(51) Int. Cl.

| | |
|---|---|
| ***B03C 1/30*** | (2006.01) |
| ***B03C 1/023*** | (2006.01) |
| ***B03D 1/14*** | (2006.01) |

(52) U.S. Cl.
CPC ..... *B03C 1/30* (2013.01); *B03C 1/023* (2013.01); *B03D 1/1418* (2013.01);
(Continued)

(58) Field of Classification Search
CPC ..... B03C 1/30; B03C 1/023; B03C 2201/18; B03C 2201/20; B03C 2203/02;
(Continued)

(56) References Cited

U.S. PATENT DOCUMENTS 4,941,969 A 7/1990 Schoenert
5,192,423 A 3/1993 Duczmal et al.
(Continued)

FOREIGN PATENT DOCUMENTS

CN 203862407 U * 10/2014
MX 2015002174 8/2016
(Continued)

*Primary Examiner* — Patrick H Mackey
(74) *Attorney, Agent, or Firm* — Clark & Brody LP

(57) ABSTRACT

The invention relates to a magneto-centrifugal flotation cell for ore concentration which reduces water consumption. A disadvantage of conventional flotation cells is the use of a large amount of water, some flotation cells requiring at least 60% water. The present invention uses ore pulp with increased density and viscosity, owing to the application of an axial magnetic field, wherein the Lorentz force, which is the force exerted by an electromagnetic field that receives a charged particle or an electrical current, can be used. The solution is a cell which, in addition to the forces that usually act on conventional flotation cells, uses external forces which, in principle, produce synergy in the separation of ore particles that have different gravitational and magnetic properties.

13 Claims, 6 Drawing Sheets

(52) U.S. Cl.
CPC ..... *B03D 1/1493* (2013.01); *B03C 2201/18* (2013.01); *B03C 2201/20* (2013.01); *B03D 2203/02* (2013.01)

(58) Field of Classification Search
CPC ..... B03C 1/288; B03C 1/0332; B03C 1/0335; B03D 1/1418; B03D 1/1493; B03D 2203/02; B03D 1/14
See application file for complete search history.

(56) References Cited

U.S. PATENT DOCUMENTS

| | | | | | |
|---|---|---|---|---|---|
| 5,224,604 | A * | 7/1993 | Duczmal | B03C 1/023 | 209/12.2 |
| 6,106,711 | A * | 8/2000 | Morse | B01D 21/2438 | 210/221.2 |
| 6,146,525 | A * | 11/2000 | Li | B01D 17/0205 | 210/221.2 |
| 2014/0183104 | A1* | 7/2014 | Rothman | B01D 37/02 | 209/168 |
| 2016/0030947 | A1* | 2/2016 | Van Zyl | B03C 1/14 | 210/695 |

FOREIGN PATENT DOCUMENTS

| | | |
|---|---|---|
| WO | 91/15302 | 10/1991 |
| WO | 2013/130794 | 9/2013 |
| WO | 2016/133379 | 8/2016 |

* cited by examiner

MAGNETO-CENTRIFUGAL FLOTATION CELL FOR CONCENTRATING MATERIALS WHICH REDUCES WATER CONSUMPTION AND METHOD OF USE

TECHNICAL FIELD OF THE INVENTION

This invention refers to an ore flotation cell with a significant reduction of water usage. More specifically, the invention refers to an ore concentration magnetic-centrifugal flotation cell that reduces water consumption.

BACKGROUND OF THE INVENTION

The ore flotation process is an industrial operation widely used to separate sulfide ores containing metals of economic interest. Many researchers have reported that the ore flotation process yields very low efficiencies if the solids percent in the slurry is increased above 40%. The increase of both slurry density and viscosity has been mentioned as one of the main reasons for the efficiency decrease. This means that each flotation cell in a circuit requires at least a 60% water percent to operate correctly. In columnar cells the solids percent is even lower and reaches values around 17%, that is, with water percent around 83%. Even though a great part of the water is recirculated, a makeup of fresh water is still required.

This invention deals with magnetic separation, since there are many documents in the state of the art on this kind of separation, both dry and wet, with a low intensity and for iron ore (of the magnetite type). There is also equipment with a wet high intensity magnetic field operating with up to tens of thousands Gauss or more; but not taking advantage of the flow velocity because they usually involve open systems of filter-style systems that take advantage of field gradients rather than field intensity.

In the state of the art there are several disclosures referred to the separation of particles using devices that generate a magnetic field. For example, document WO 2016/133379 discloses a new device and procedure to enrich magnetic ores (magnetite) by means of the elimination of metal sulfides, silicates, phosphates, and other undesired particles, characterized by a device that comprises a descendent flow tube (mixer) and a separation column surrounded by Helmholtz coils. The slurry is fed into the mixer, where the air bubbles are formed in the presence of the slurry and the particles are collected from this pulp and slurry. The slurry and bubbles mixture are transferred from the mixer into the separation column in a region having a low intensity magnetic field, under 200 Gauss, which may be adjusted. The non-magnetic particles (gangue) are eliminated by the bubbles in the top section of the column generating the process residues, while the magnetic particles settle rapidly at the lower section of the column, where they are taken to constitute the iron concentrate. As a result of the increase in the solids percent of the concentrate stream found at the lower section of the tube, most of the water fed to the device is discharged in the tails, generating an increase of water mass flow rate that takes away the gangue particles that were not captured by the bubbles. In the use of these mechanisms, gangue material is discharged into the tails by two methods: flotation and hydrodynamic resistance. The magnetite particles form aggregates with a weight that suffices for not being transported by the bubbles but rapidly settling at the lower section of the column, allowing the selective separation of magnetite and gangue.

The apparatus described in document WO 2016/133379 is designed for the separation of magnetic ore, magnetite, where a magnetic field has a direct influence on the particles. This apparatus cannot be used in the separation of sulfide ores containing metals having an economic interest.

Document U.S. Pat. No. 5,224,604 discloses an apparatus and a method for the separation of particles in a fluid or gas flow. The fluid flow is directed in a turbulence flow pattern in order to generate centrifugal forces. Optionally, magnetic and/or electric fields may be applied to the system in order to improve the separation of particles. Air bubbles may also be used to additionally improve the separation of hydrophilic particles from hydrophobic particles in a liquid system. Optionally, the turbulence pattern of the flow may leave the downstream end of the separator, where a flow divider is used to divide the turbulence pattern of the flow bursting out into two or more flows that transport particles desirable for recovery. The apparatus is made up of a vertical tube, whose exterior has vertical magnets parallel to the symmetry axis of the tube that generates a magnetic field.

The apparatus disclosed in document U.S. Pat. No. 5,224,604 has the disadvantage that air injection is made across the porous wall of the cylinder mantle, in order to generate a vacuum and to reduce the slurry resistance to the entry of gas. However, this solution is not the best possible because it is extremely difficult to control and the pressure increases significantly.

In addition, the apparatus disclosed in document U.S. Pat. No. 5,224,604 also uses a magnetic field for separation, utilizing the vertical magnets parallel to the symmetry axis of the tube. However, this magnetic field arrangement crosses perpendicularly as opposed to the magnetic field used in this invention, which will be explained below.

SUMMARY OF THE INVENTION

The disadvantage of conventional flotation cells is that they use a large amount of water, where some cells require at least 60% of water. In columnar cells the percentage of solids can be as low as 17%, that is, with water percents around 83%. The purpose of new designs for flotation cells is to increase treatment capacity (showing a tendency to giant cells of up to 600 m3) or to increase process efficiency (recovery of valuable material and/or generation of concentrated product with a greater ore percentage or grade containing the element with economic value). There is no industrial evidence of new flotation cell designs that effectively reduce the use of water.

This invention uses ore slurry with greater density and viscosity, caused by the application of an axial magnetic field, where it is possible to benefit from the Lorentz force, the force exerted by an electromagnetic field that receives a charged particle or an electric current.

In a generated magnetic field, it is possible to find that the Lorentz force depends on the magnitude of the charge, its velocity, and field intensity, where the force may be increased not only increasing the magnetic field or the charge buy also its velocity. Many sulfide minerals having economic value do not develop net charges as important as the ones observed, for example, in magnetite. In order to increase the force, it is possible to independently vary the intensity of the magnetic field and the charge velocity. The key point behind these variations is that the force must have a preferential direction given by the cross product (vector product) between the axial magnetic field vector and the particles' velocity vector. This is achieved with helicoidal trajectories and other more complex trajectories acquired by the particles and the fluid once they tangentially enter the cell and the axial magnetic field aligned with the axial axis of the cell.

The solution is a cell that uses, in addition to the forces habitually acting in conventional flotation cells, external forces that, in principle, produce a synergy in the separation of ore particles.

BRIEF DESCRIPTION OF THE DRAWINGS

The attached drawings are included to provide a greater understanding of the invention and constitute a part of this description and help to explain its principles.

DESCRIPTION OF THE INVENTION

This invention refers to a magnetic-centrifugal flotation cell for the concentration of ore that reduces water requirements. The operation of this flotation cell will be explained based on the attached drawings and the theoretical principles of the phenomena that take place inside the same.

In the first place, it is accepted that the impact of centrifugal effects habitually brings together mass separation (density and size, because mass is proportional to the product of density times the size to the cube) of particles, where the particles with a greater mass, in principle, will move eccentrically while the lighter particles will be initially transported by the concentric axis of the cylinder or the eddy located at the center of the tube. This commonly observed motion of particles is subsequently modified by the magnetic field applied that exacerbates the separability of semiconductor material of the sulfide type. It is expected that the movement of bubbles and particle-bubble aggregates towards the external mantle prevents coalescence and promotes the dispersion of the gas phase because the bubbles will experience shear stresses that will help gas dispersion.

Figure 1:
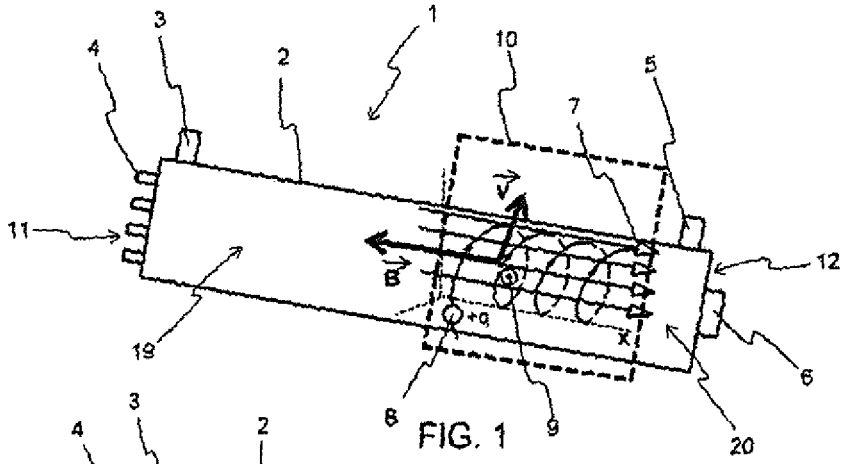
FIG. 1 shows a first experimental schematic of this invention.
Figure 2:
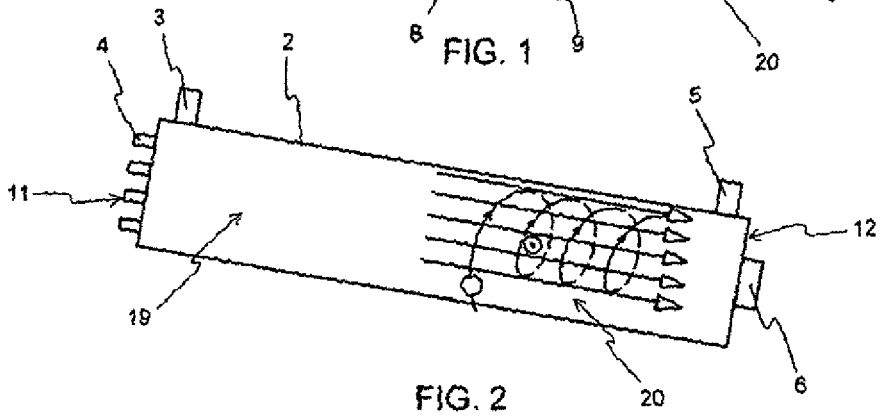
FIG. 2 shows a second experimental schematic of the flotation cell in this invention.
Figure 3:
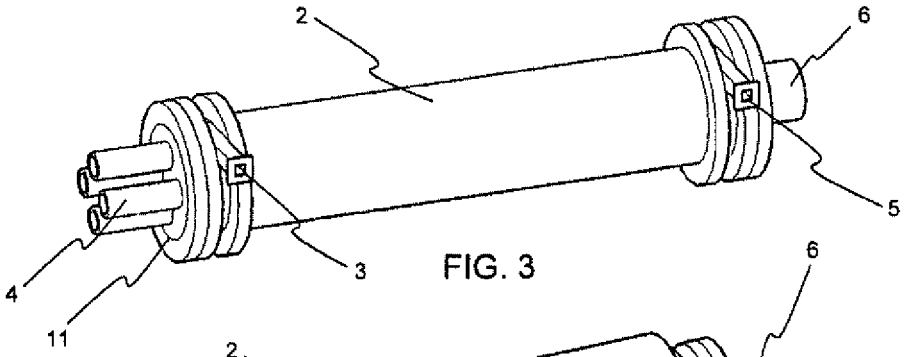
FIG. 3 is the rear view of a magnetic flotation cell mode in this invention.

FIGS. 1 and 2 show an experimental schematic of the magnetic flotation cell (1) of this invention. The magnetic flotation cell (1) is made up by a hollow tubular container (2), whose length is greater than its width and its inside holds a first segment (19) that generates bubbles in a turbulent medium with the coming together of the air and ore slurry flows and a second segment (20) where the bubble flow is stabilized and the heavier particles flow eccentrically while the lighter particles will be transported by the concentric axis of the tubular container (2).

One of the ends of the tubular container (2) holds a first face (11) and the other end holds a second face (12). The air entrances (4) are found in the first face (11) and on the side of the tubular container mantle (2) and the ore entrance (3) is located close to the air entrances (4). The material eccentric lateral exit (5) is found close to the second end and perpendicular to the symmetry axis of said tubular container (2), which may or may not follow the flow mainly governed by the helicoidal motion of the complex fluid. The material concentric exit (6) is placed on the second face (12). The axial magnetic field (10) is found around the tubular container (2) and positioned towards the turbulence area, close to the second face (12).

The axial magnetic field (10) in the first embodiment of the invention is provided by a coil (13) with its respective power supply and, alternatively, permanent magnets may be used in order to avoid the electric energy expense at the coil (13).

Experiments were conducted on the basis of the preceding scheme and the first embodiment of the invention, whose results indicate that the eccentric lateral exit (5) displays foam similar to the foam seen in conventional concentrate flotation cells with watery slurry, preliminarily indicating that particulate matter containing valuable material was obtained at this exit. This indicated that the centrifugal effect, the magnetic effect, or both, when air comes into the system as shown in FIG. 1 (please note that the ore feeding entrance (3) is very close to the air entrances (4) allowing a kind of gas suction at this point), have an ore concentration effect, a symptom indicating that the invention allows separation similar to a conventional flotation cell. In addition, setting aside some out of trend points it is possible to see that the recovery and grade curve behaves very similarly to a state-of-the-art classical flotation cell.

As shown in FIGS. 1 and 2, the ore slurry enters the magnetic flotation cell (1) through the ore feed entrance, encountering the air that comes in through the air entrances (4) in order to make up the bubbles. Having flowed through a part of the segment of the tubular container (2), the current stabilizes and the particles are separated by their mass, where the heavier particles (8) will move eccentrically outwards, generating a vector (9) perpendicular to the symmetry axis of the tubular container (2), leaving the cell through the eccentric lateral exit (5), while the light particles will be transported by the concentric axis of the tubular container (2) and will leave the cell with a current (7) through the concentric material exit (6).

As already indicated, an axial magnetic field (10) is applied to the flotation cell. Thus, it is possible to analyze the Lorentz force, to determine how a magnetic force acts on a particle with charge q as shown in Equation 1.

$$F=q[E+vxB] \tag{1}$$

where q is the charge, E represents the electric field, v is the particle velocity, and B is the magnetic field.

The experiments were conducted with continuous current so that the effect of the electric field is negligible. Equation 1 becomes Equation 2.

$$F=q[vxB] \tag{2}$$

The force on particle (8) increases with the increase of the magnetic field obtained using electric current, which may involve an expense, particularly at high capacity ore treatment industrial levels.

Since ore particles exhibit a low charge, it is necessary to increase their velocity. In this apparatus, this is achieved using the centrifugal effect on the particles along the tubular container (2).

In short, it is possible to conclude that the position of the axial magnetic field (10) causes particles, bubbles, and/or particle-bubble aggregates slightly charged by their tangential motion velocity and the field direction to move eccentrically and be recovered in tangential exits.

Figure 4:
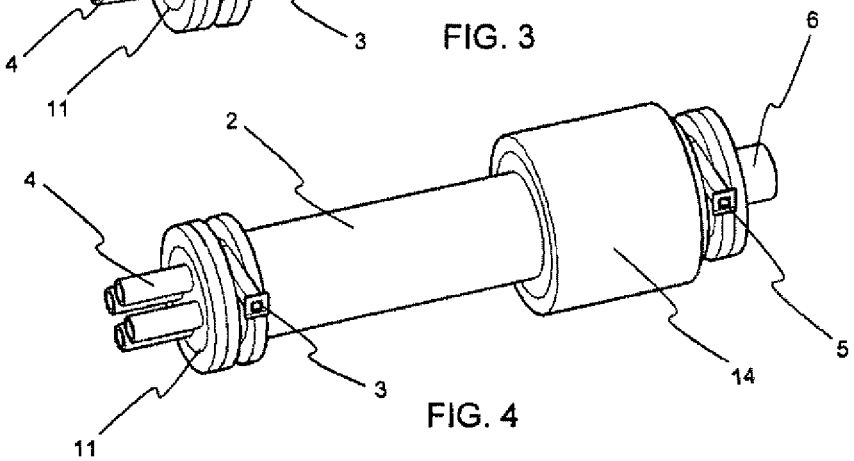
FIG. 4 is the rear view of a magnetic flotation cell mode in this invention with the cover that protects the coil.
Figure 5:
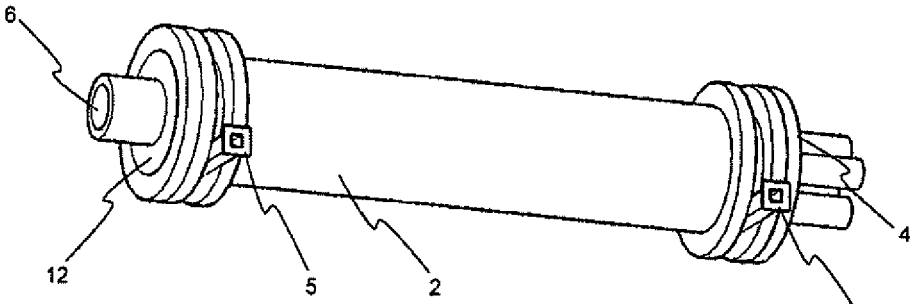
FIG. 5 is the front view of a magnetic flotation cell mode in this invention.
Figure 6:
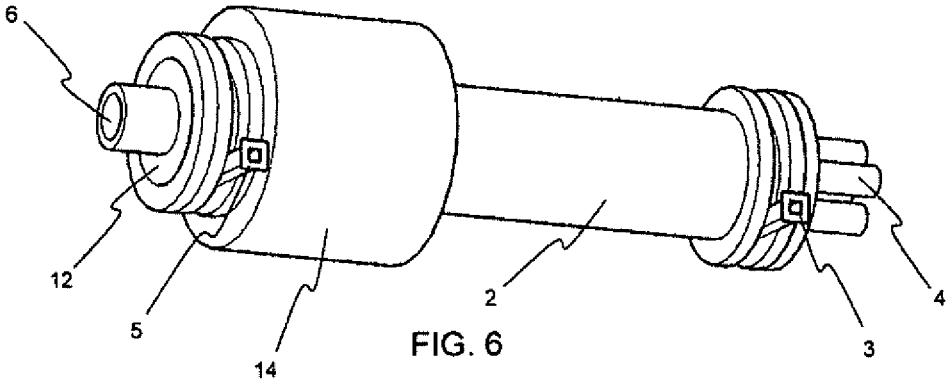
FIG. 6 is the front view of a magnetic flotation cell mode in this invention with the cover that protects the coil.

One of the preferred modes of this invention is shown in FIGS. 3 to 6, where a hollow tubular container (2) acts as a chamber to process mineral slurry. At one end, an air entrance (4), preferable four, and, perpendicular to the air flow, the tubular container (2) has an ore feed entrance (3). At the other end where the second face is located (12), the tubular container (2) has a concentric material exit (6) and, very close to it and perpendicular to the symmetry axis, an eccentric lateral exit (5) is found. Referring to FIGS. 4 and 6, the magnetic flotation cell has a cover (14) to protect the coils (13) that generate the axial magnetic field (10) for the magnetic flotation cell (1).

In another embodiment, the cover (14) may also be used to protect permanent magnets that provide an axial magnetic field (10).

The cover (14) is placed outside the mantle of the tubular container (2), covering the coil in the second segment (20) as shown in FIGS. 4 and 6. If the coil is placed along the entire tubular container (2), then the cover (14) must also be placed along the entire tubular container (2).

As already mentioned, the tubular container (2) has a flow segment (19) with the entrance of ore and air, so that this segment becomes a turbulent zone where bubbles are formed. Likewise, the tubular container (2) has a second segment (20) with the eccentric lateral exit (5) and the materials concentric exit (6), where the flow of bubbles is stabilized and the heavier particles flow eccentrically while the light particles will be transported by the concentric axis of the tubular container (2).

Since the slurry flow in the second segment (20) of the tubular container (2) is relatively more stable, with and eddy flow and a concentric flow, it is in this segment where it us useful to install the coil (13), given that the axial magnetic field exercises its effect on an ordered flow of particles.

Although the preceding condition is quite reasonable, it is not proper to dismiss having a short turbulent first segment (19) and a longer stability segment in an eddy flow and a concentric flow, so that the coil (13) may cover the entire tubular container (2). The same would happen if permanent magnets are used to generate the axial magnetic field (10).

The axial magnetic field for the tubular container (2) may also be generated with permanent magnets. It is well known that using coils (13) demands electric current, which may limit the large-scale application of the invention. The permanent magnets may be made of neodymium or something similar.

EXPERIMENTAL EXAMPLE

Figure 7:
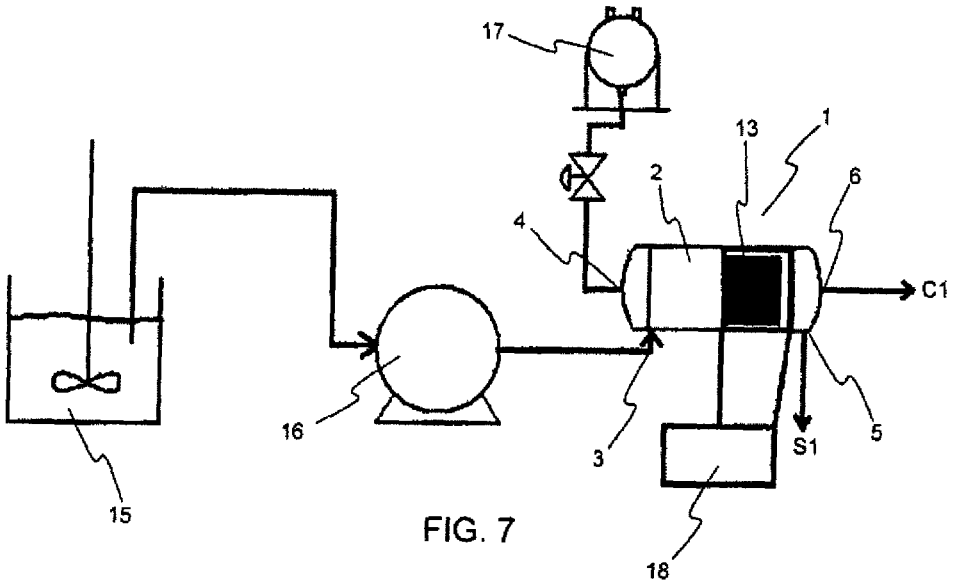
FIG. 7 shows the arrangement of the equipment used in the experimental validation of the magnetic flotation cell in this invention.

FIG. 7 shows the experimental system used herein. Into an agitated tank (15) was introduced a slurry from a mining site with a 50% content of solids and a copper grade around 0.8%. Using a peristaltic pump (16), the slurry is taken towards the flotation cell (1) coming in through the ore feed entrance (3), where the cell may work with or without an axial magnetic field and generating, in any case, 2 products: C1: central flow and S1: tangential exit flow. In order to generate the bubbles, there is a pressurized air generator (17) and air is injected to the tubular container (2) through the air entrances (4). The flotation cell may operate horizontally or vertically with the ore being fed from above or from below when operating vertically.

The field intensity used herein was approximately 0.001 T using 2 Amp direct current and a copper wire solenoid with approximately 500 turns in a segment approximately 20 cm long. The electric energy was provided by an 18 volt power supply.

Table 1 shows the experiments carried out.

TABLE 1

Set of Experiments

| Experimental Run | Tube Orientation | Axial Magnetic Field |
|---|---|---|
| P1 | Horizontal | No |
| P2 | Top vertical feed | No |
| P3 | Bottom vertical feed | No |
| P4 | Horizontal | Yes |
| P5 | Top vertical feed | Yes |
| P6 | Bottom vertical feed | Yes |

The samples were taken at both exits of the apparatus and sent to an automated mineralogical analysis using QEMSCAN®. In order to reconcile the copper grades, the feed was backcalculated, and the recoveries were estimated.

Results

The recovery results for each one of the elements measured using the QEMSCAN® technique are shown in Table 2.

TABLE 2

Recovery of each element in each experiment

| | Experiment No. | | | | | |
|---|---|---|---|---|---|---|
| Element | P1 | P2 | P3 | P4 | P5 | P6 |
| Al | 10.3 | 49.1 | 60.6 | 57.7 | 65.5 | 53.4 |
| B | 8.3 | 40.0 | 75.0 | 40.0 | 60.0 | 66.7 |
| C | 15.3 | 33.3 | 60.0 | 50.0 | 55.6 | 33.3 |
| Ca | 9.4 | 44.9 | 59.4 | 54.5 | 59.5 | 51.4 |
| Cu | 19.3 | 52.1 | 27.0 | 22.4 | 20.8 | 49.0 |
| F | 11.8 | 53.3 | 61.5 | 70.0 | 66.7 | 46.7 |
| Fe | 18.8 | 57.8 | 29.5 | 29.9 | 22.6 | 50.3 |
| H | 9.9 | 47.4 | 62.5 | 60.0 | 66.7 | 52.9 |
| K | 10.8 | 46.7 | 60.9 | 59.9 | 64.2 | 51.6 |
| Mg | 10.1 | 44.8 | 61.8 | 57.6 | 60.5 | 52.2 |
| Mo | 23.2 | 69.2 | 17.6 | 40.0 | 0.0 | 18.2 |
| Na | 9.3 | 50.2 | 59.0 | 55.8 | 63.8 | 56.3 |
| O | 9.7 | 48.1 | 60.0 | 58.2 | 63.4 | 50.0 |
| P | 8.3 | 42.9 | 42.9 | 45.5 | 55.6 | 50.0 |
| S | 18.9 | 57.4 | 29.6 | 28.9 | 22.1 | 49.9 |
| Si | 9.6 | 48.5 | 59.8 | 58.7 | 63.4 | 49.3 |
| Ti | 9.3 | 47.1 | 63.2 | 50.0 | 56.5 | 54.5 |
| Zn | 100.0 | 50.0 | 0.0 | 40.0 | 0.0 | 100.0 |
| Rm (%) | 10.8 | 13.6 | 40.9 | 10.5 | 16.4 | 38.5 |

It may be seen that copper recovery ranges between approximately 19% and 52% and it is difficult to get these recoveries in conventional cells with a 50% of solids. Therefore it is possible to claim that this magnetic flotation cell considerably brings down water requirements. The maximum observed recovery ranged approximately between 10%, the customary value in rougher cells, and 40%.

Figure 8:
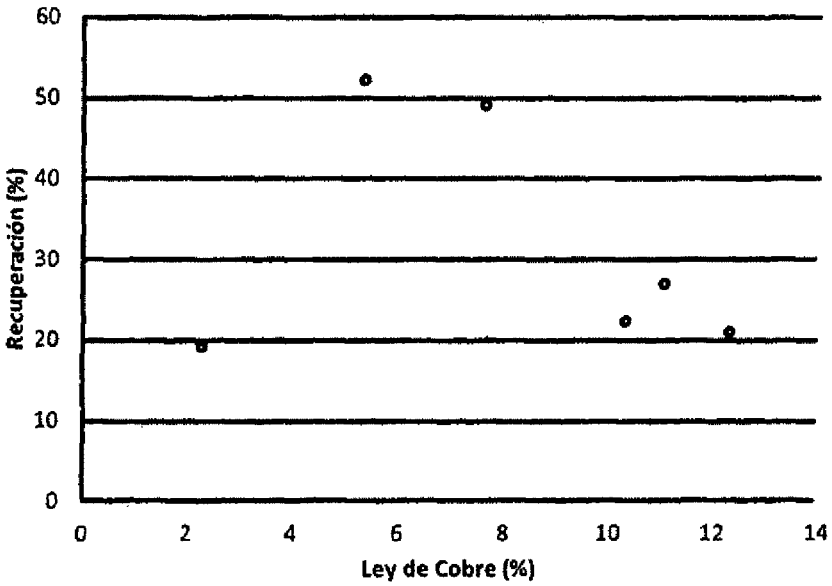
FIG. 8 shows a chart with recovery vs copper grade considering the tangential outflow.

As expected, the recovery vs copper grade relationship has a behavior like the one observed in conventional cells, as shown in the recovery vs copper grade chart that only considers the tangential exit in FIG. 8.

The copper enrichment ratios range between 2 and 15, also observed in conventional cells with lower percentages of solids (30% and less).

Figure 9:
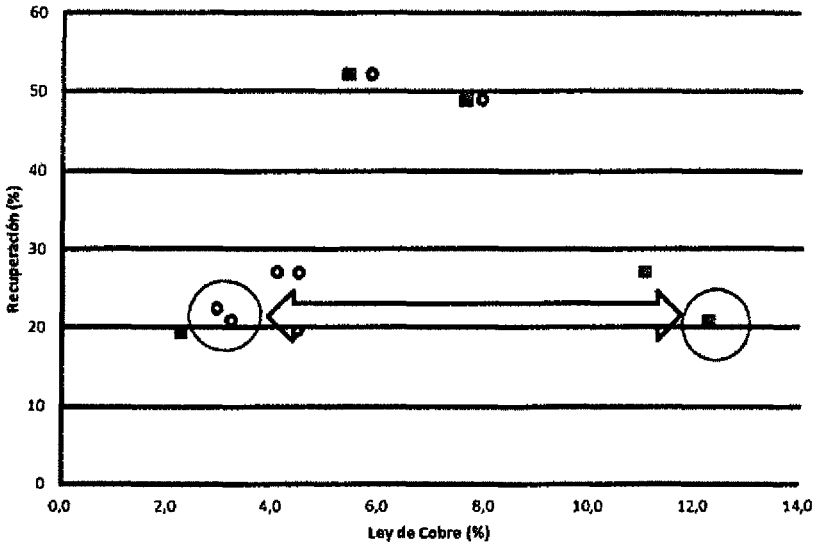
FIG. 9 shows a chart with recovery vs grades observed in both outflows (central and tangential).

FIG. 9 shows recovery vs copper grades considering both the center exit and the tangential exit of the magnetic flotation cell. It may be seen that the best experimental condition, allowing the maximum grade differences between both exits corresponds to experiment P4 with the equipment in a horizontal position and using the axial magnetic field.

CONCLUSION

The magnetic flotation cell invention obtains important recoveries and grades compared to those observed in conventional flotation cells operating with 50% of solids. Preliminarily, the best experimental condition was achieved working with the new cell in a horizontal position with the application of a magnetic field. In only one run, this condition obtains enrichment ratios above 10% and recovery ratios above 20%. In theory, it may be expected that the cell should also allow working with up to approximately 70% of solids.

The invention claimed is:

1. A magnetic-centrifugal flotation cell for the concentration of ore that reduces water consumption, made up with a tubular container (2) acting as a chamber to process ore slurry and elements to provide a magnetic field, wherein said tubular container (2) comprises:

a first segment (19) generating turbulent bubbles;

a second segment (20) with a stabilized bubbles flow;

one end where a first face (11) is found, with at least one air entrance (4), and, at one side of said tubular container and close to said face (11) has an ore feed entrance (3);

a second end where a second face is found (12), with one concentric material exit (6), and, at a side close to said face (12), a lateral eccentric exit (5) is found;

elements to generate an axial magnetic field located at the external perimeter of the tubular container (2);

a cover (14) that encloses said elements to generate an axial magnetic field (10).

2. The magnetic-centrifugal flotation cell, according to claim 1, wherein the elements used to generate an axial magnetic field (10) are only located at a perimeter where the second segment (20) with the stabilized bubble flow is found (2).

3. The magnetic-centrifugal flotation cell, according to claim 1, wherein the elements used to generate an axial magnetic field (10) are found along an entire perimeter of the tubular container (2).

4. The magnetic-centrifugal flotation cell, according to claim 3, wherein the cover is located outside and all along the cover of the tubular container (2).

5. The magnetic-centrifugal flotation cell, according to claim 1, wherein the elements used to generate an axial magnetic field (10) are a coil (13) and a power supply (18).

6. The magnetic-centrifugal flotation cell, according to claim 5, wherein the cover it is placed outside a mantle of the tubular container (2), covering the coil at the second segment (20).

7. The magnetic-centrifugal flotation cell, according to claim 1, wherein the elements used to generate an axial magnetic field (10) are permanent magnets.

8. The magnetic-centrifugal flotation cell, according to claim 7, wherein the permanent magnet is neodymium.

9. The magnetic-centrifugal flotation cell, according to claim 1, wherein the tubular container it has a plurality of air entrances (4).

10. The magnetic-centrifugal flotation cell, according to claim 9, wherein the tubular container has four or more air entrances (4).

11. The magnetic-centrifugal flotation cell according to claim 1, wherein the tubular container has a generally horizontal orientation.

12. A magnetic-centrifugal flotation process for the concentration of ore that reduces water consumption, which is made up of a tubular container (2) acting as a chamber to process an ore slurry and elements to provide a magnetic field, wherein the process comprises the steps of:

a) inputting ore slurry through an ore feeding entrance;

b) inputting air through at least one air feeding entrance;

c) generating a first segment in the tubular container with turbulent bubbles;

d) generating a second segment in the tubular container with a stabilized flow of bubbles; where heavier particles of the ore flow eccentrically while light particles of the ore are transported by a concentric axis of the tubular container;

e) generating an axial magnetic field using the elements that provide the magnetic field, which acts as a magnetic force on the particles; and f) recovering the ore at a lateral eccentric exit and a concentric ore exit.

13. The magnetic-centrifugal flotation process according to claim 12, wherein the at least one air feeding entrance is at a first face on one end of the tubular container.

* * * * *